US009831564B1

(12) United States Patent
Xie

(10) Patent No.: US 9,831,564 B1
(45) Date of Patent: Nov. 28, 2017

(54) SYSTEM-ON-PACKAGE INTEGRATION WITH ANTENNA ELEMENTS

(71) Applicant: Rockwell Collins, Inc., Cedar Rapids, IA (US)

(72) Inventor: Chenggang Xie, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 197 days.

(21) Appl. No.: 14/258,805

(22) Filed: Apr. 22, 2014

(51) Int. Cl.
*H01Q 21/00* (2006.01)

(52) U.S. Cl.
CPC ..... *H01Q 21/00* (2013.01); *H01Q 21/0087* (2013.01)

(58) Field of Classification Search
CPC .... H01Q 1/2283; H01Q 9/0407; H01Q 25/00; H01Q 13/085; H01Q 19/30; H01Q 9/26
See application file for complete search history.

(56) References Cited

U.S. PATENT DOCUMENTS

2009/0315797 A1* 12/2009 Rofougaran ..... H01Q 1/2283 343/787
2010/0327068 A1* 12/2010 Chen ..... G06K 19/07749 235/492
2014/0176368 A1* 6/2014 Kamgaing ..... H01P 11/00 343/700 MS

* cited by examiner

*Primary Examiner* — Graham Smith
*Assistant Examiner* — Noel Maldonado
(74) *Attorney, Agent, or Firm* — Angel N. Gerdzhikov; Donna P. Suchy; Daniel M. Barbieri

(57) ABSTRACT

Antenna systems and packaging methods that reduce packaging and circuit board complexities are disclosed. The antenna system includes a circuit board. The circuit board defines a first surface and a second surface opposite to the first surface. The antenna system also includes a plurality of integrated antenna elements positioned on the first surface of the circuit board. Each integrated antenna element of the plurality of integrated antenna elements includes an antenna element, a printed circuit board and a radio frequency integrated circuit chip. Each integrated antenna element of the plurality of integrated antenna elements is packaged as a three-dimensional stack package.

20 Claims, 3 Drawing Sheets

SYSTEM-ON-PACKAGE INTEGRATION WITH ANTENNA ELEMENTS

TECHNICAL FIELD

The present disclosure relates generally to integrated circuit packaging, and more particularly to system-on-package integration with antenna elements.

BACKGROUND

An electronically scanned array (ESA) is a type of phased array whose transmitter and receiver functions are composed of numerous small solid-state transmit/receive modules. The pitch between adjacent antenna elements in such an array is about a half to three quarters of the wavelength of the carrier. As frequency increases, the pitch between adjacent elements decreases and the complexities associated with packaging such antenna arrays increases.

SUMMARY

The present disclosure is directed to an antenna system. The antenna system includes a circuit board. The circuit board defines a first surface and a second surface opposite to the first surface. The antenna system also includes a plurality of integrated antenna elements positioned on the first surface of the circuit board. Each integrated antenna element of the plurality of integrated antenna elements includes an antenna element, a printed circuit board and a radio frequency integrated circuit chip. Each integrated antenna element of the plurality of integrated antenna elements is packaged as a three-dimensional stack package.

Another embodiment of the present disclosure is also directed to an antenna system. The antenna system includes a circuit board. The circuit board defines a first surface and a second surface opposite to the first surface. The antenna system also includes a plurality of integrated antenna elements. Each integrated antenna element of the plurality of integrated antenna elements includes an antenna element, a printed circuit board and a radio frequency integrated circuit chip. Each integrated antenna element of the plurality of integrated antenna elements is packaged as a three-dimensional stack package. The antenna system further includes a plurality of digital control integrated circuits. Each particular digital control integrated circuit of the plurality of digital control integrated circuits corresponds to a particular integrated antenna element of the plurality of integrated antenna elements, wherein each particular digital control integrated circuit is positioned on the first surface of the circuit board, and the particular integrated antenna element corresponding to the particular digital control integrated circuit is stacked on top of the particular digital control integrated circuit.

A further embodiment of the present disclosure is directed to a method for producing a package with integrated antenna elements. The method includes: forming a plurality of integrated antenna elements, each integrated antenna element of the plurality of integrated antenna elements including an antenna element, a printed circuit board and a radio frequency integrated circuit chip, each integrated antenna element of the plurality of integrated antenna elements being packaged as a three-dimensional stack package; and placing the plurality of integrated antenna elements on a surface of a circuit board, wherein the plurality of integrated antenna elements jointly form an antenna array.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION

Reference will now be made in detail to exemplary embodiments of the disclosure, examples of which are illustrated in the accompanying drawings.

Figure 1:
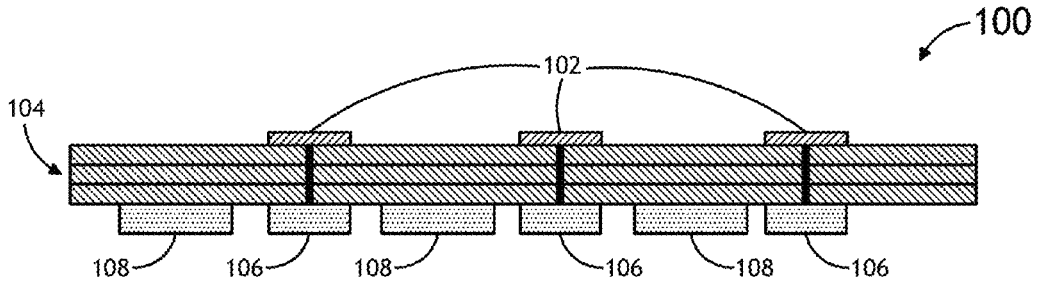
FIG. 1 is an illustration depicting a conventional electronic scan phase array.

As shown in FIG. 1, an electronically scanned array may be packaged as an antenna system 100, wherein the antenna elements 102 can be printed on one side (i.e., the top surface as shown in FIG. 1) of a circuit board 104 while the frontend integrated circuits 106 and the digital/analog control integrated circuits 108 are mounted on the other side (i.e., the bottom surface as shown in FIG. 1) of the circuit board 104. Since the circuit board 104 has to accommodate all digital, analog, power and radio frequency routing requirements, it becomes complicated and expensive.

Furthermore, the complexity increases as the frequency increases. That is, the pitch between adjacent antenna elements 102 in such an array is about a half to three quarters of the wavelength of the carrier for ESAs or spatial combiners. As frequency increases, the pitch between adjacent elements decreases and the complexities therefore increases.

The present disclosure is directed to antenna systems and packaging methods that reduce packaging and circuit board complexities. More specifically, system-on-package with integrated antenna elements are produced and stacked on top of the packages to form antenna arrays. In this manner, the design of the circuit board (referred to as the master board) can be significantly simplified. System-on-package is a microelectronic technology that places an entire system on a single chip-size package. System-on-package saves interconnection time and heat generation by keep a full system with computing, communications, and consumer functions all in a single chip.

Figure 2:
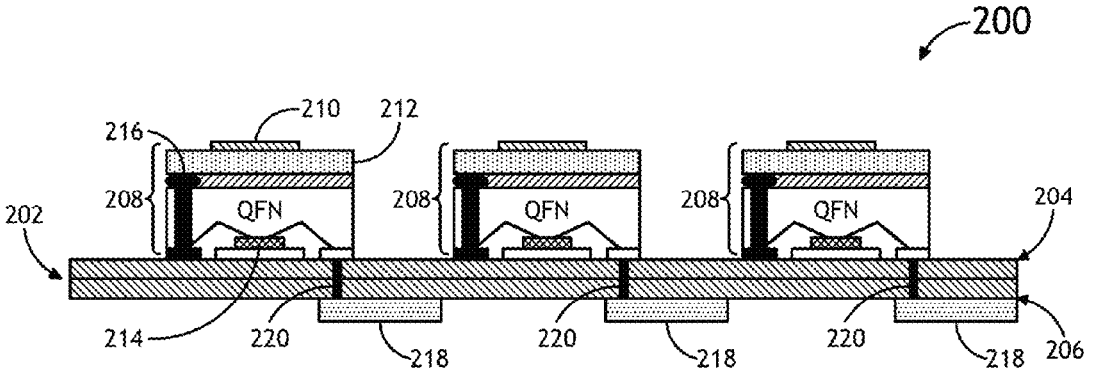
FIG. 2 is an illustration depicting an electronic scan phase array in accordance with one embodiment of the present disclosure.

Referring to FIG. 2, an illustration depicting an antenna system 200 in accordance with one embodiment of the present disclosure is shown. The antenna system 200 includes a circuit board 202 defining a first (top) surface 204 and a second (bottom) surface 206 opposite to the first surface. Positioned on the first surface 204 are multiple system-on-package integrated antenna elements 208. As depicted in FIG. 2, each system-on-package integrated antenna element 208 includes an antenna element 210 (e.g., a planner/patch antenna), a printed circuit board 212 and a radio frequency integrated circuit (RFIC) chip 214. Furthermore, the antenna element 210, the printed circuit board 212 and the RFIC chip 214 are packaged as a three-dimensional stack package.

In one embodiment, the antenna element 210, the printed circuit board 212 and the RFIC chip 214 are packaged utilizing through mold via techniques. As shown in FIG. 2, a flat no-leads (e.g., quad-flat no-leads or QFN) package is used to surface mount the system-on-package integrated antenna element 208 to the master board 202. The RFIC chip 214 is encapsulated within the QFN and the antenna element 210 is connected to the RFIC chip 214 through the printed circuit board 212 utilizing at least one via 216. It is understood that other system-on-package integrated antenna elements 208 may be packaged in the similar manner as described above. However, it is contemplated that various other types of three-dimensional stacking techniques may be utilized to package the system-on-package integrated antenna elements 208 without departing from the spirit and scope of the present disclosure.

It is also contemplated that these individually packaged integrated antenna elements 208 may be positioned on the first surface 204 of the circuit board 202 accordingly to any specified layout. For instance, they may jointly form an electronically scanned array (ESA). Furthermore, additional integrated circuits 218 such as frontend circuits, digital control circuits, analog control circuits or the like can be placed on the second (bottom) surface 206 of the circuit board 202. Additional vias 220 can be used to establish connections necessary between components placed on the top and bottom surfaces 204 and 206. In one embodiment, the digital control circuits placed on the second surface 206 are in communication with their corresponding integrated antenna elements 208, and the digital control circuits are utilized to control beam forming capabilities of the integrated antenna elements 208.

Figure 3:
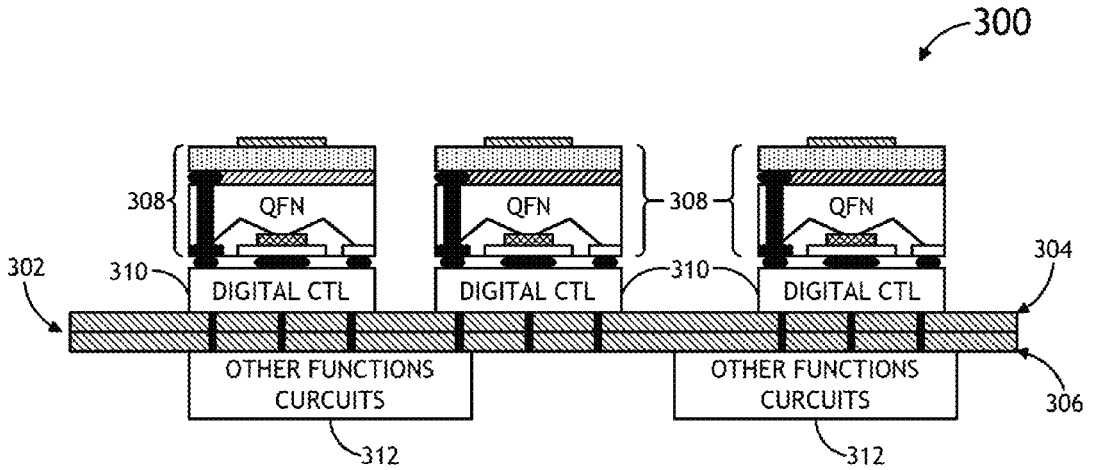
FIG. 3 is an illustration depicting an electronic scan phase array in accordance with another embodiment of the present disclosure.

In an alternative embodiment, instead of placing the digital control circuits on the opposite side of the circuit board 202, these control circuits can be stacked together with the integrated antenna elements 208 on the same side of the circuit board 202. Referring to FIG. 3, an illustration depicting an antenna system 300 in accordance with an alternative embodiment of the present disclosure is shown. The antenna system 300 includes a circuit board 302 defining a first (top) surface 304 and a second (bottom) surface 306 opposite to the first surface. As depicted in FIG. 3, each integrated antenna element 308 is packaged in a similar manner as described above. However, instead of directly being mounted to the top surface 304 of the circuit board 302, each integrated antenna element 308 is stacked on top of its corresponding digital control circuits 310. In this embodiment, the other additional integrated circuits 312 may be placed on the bottom surface 306 of the circuit board 302, and connections between components placed on the top and bottom surfaces 304 and 306 are facilitated through various vias defined in the circuit board 302.

It is contemplated that whether the digital control circuits need to be stacked on the same side as the integrated antenna elements may be a design choice and may differ based on a specific antenna design and application requirement. It is also contemplated that in certain configurations, additional levels of stacking may be utilized without departing from the spirit and scope of the present disclosure.

Figure 4:
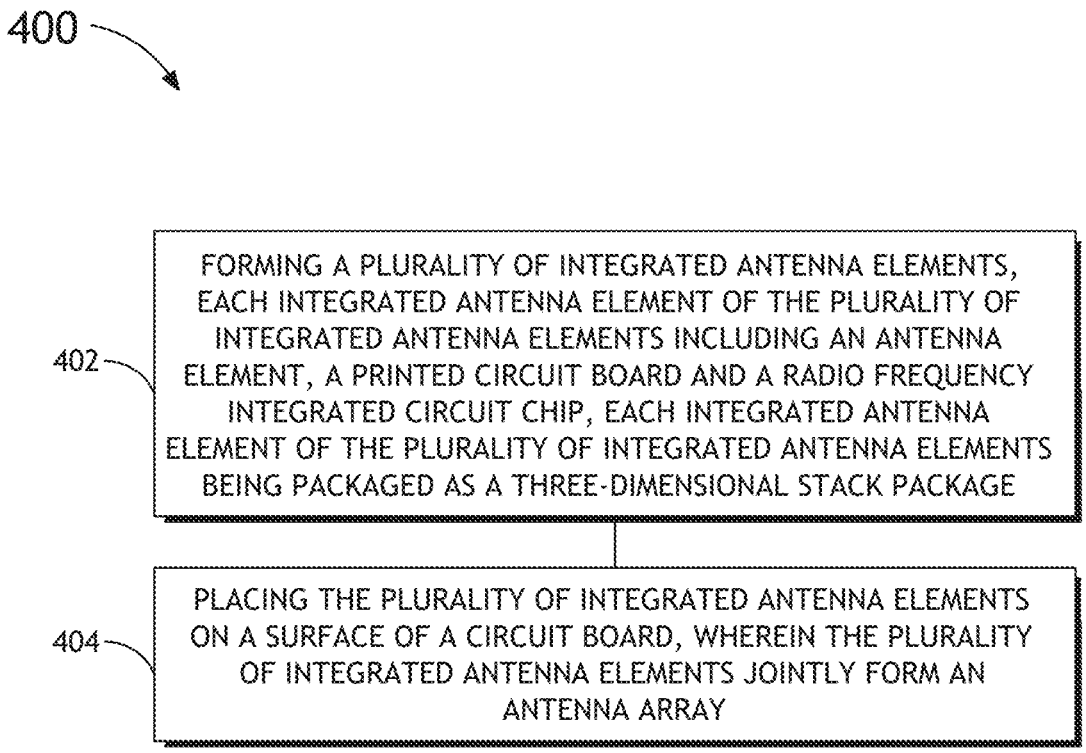
FIG. 4 is a flow diagram depicting a method for manufacturing an electronic scan phase array.

Referring now to FIG. 4, a flow diagram depicting a method 400 for producing a package with integrated antenna elements is shown. A plurality of integrated antenna elements may be formed first in step 402. As described above, each integrated antenna element may include an antenna element, a printed circuit board and a RFIC chip packaged as a three-dimensional stack package. The plurality of integrated antenna elements may then be placed on a surface of a circuit board in step 404. In one embodiment, the plurality of integrated antenna elements jointly forms an antenna array as previously described.

Figure 5:
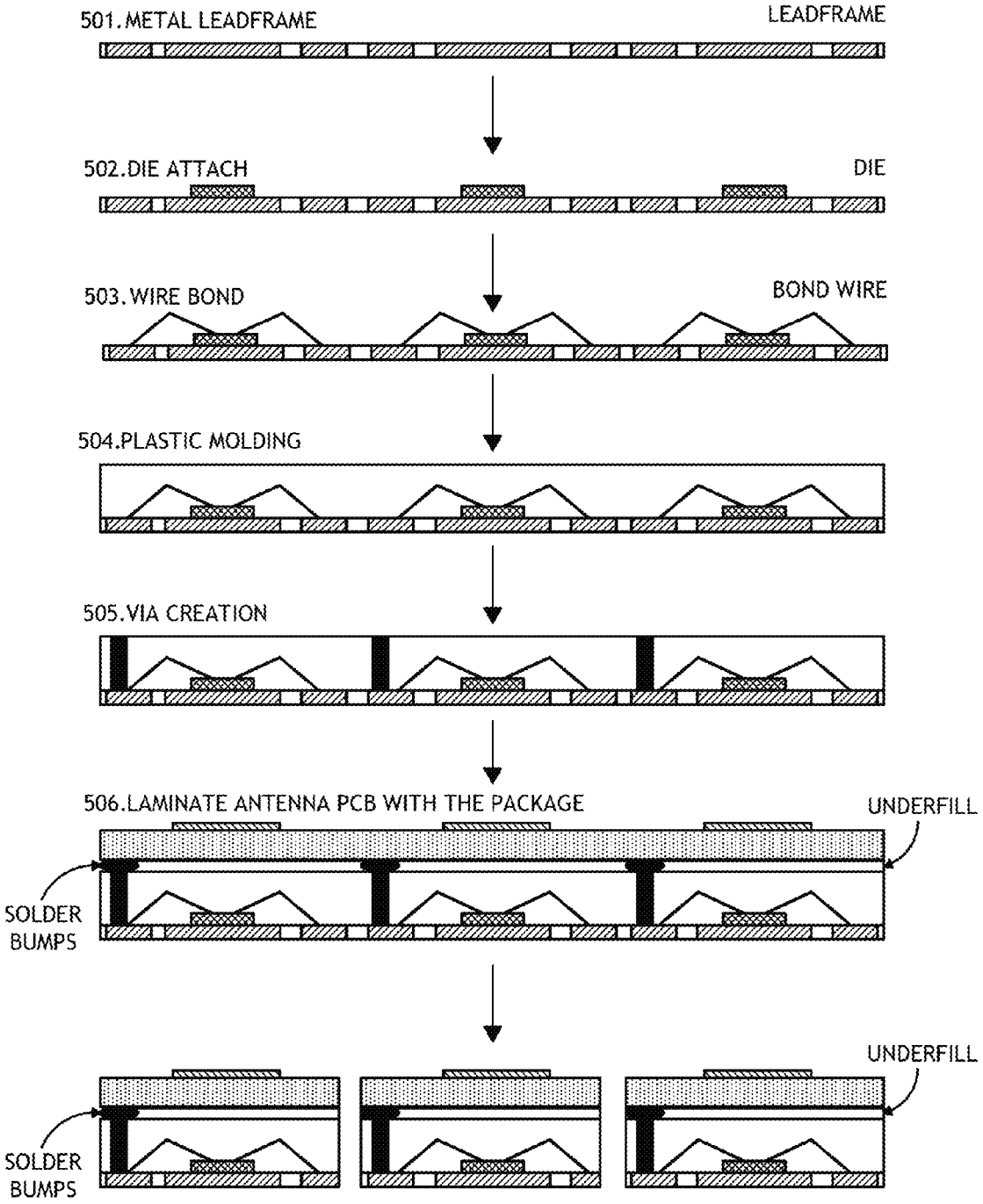
FIG. 5 is an illustration depicting an exemplary manufacturing process of antenna elements.

It is contemplated that different fabrication techniques may be utilized to produce the plurality of integrated antenna elements. FIG. 5 is an illustration depicting one exemplary fabrication process, wherein multiple integrated antenna elements can be produced together simultaneously. More specifically, with the leadframe secured in step 501, multiple dies (e.g., RFIC chips) can be positioned in place in step 502 and connections (e.g., wire bond) can be established in step 503. Subsequently, plastic encapsulation can be applied in step 504 and vias can be defined/created in step 505. The antenna elements along with the antenna circuit board can be laminated with the package in step 506, wherein the connections between the antenna elements and their corresponding RFCI chips are established using the vias defined through the encapsulation. Subsequently, these antenna elements, packaged with their corresponding RFCI chips, are separated from each other, and individual system-on-package integrated antenna elements are produced.

It is understood that the illustration depicted in FIG. 5 is merely exemplary. The number of integrated antenna elements that can be produced simultaneously is not limited to three as shown in the figure. It is also understood that various other types of fabrication techniques may be utilized to produce the integrated antenna elements without departing from the spirit and scope of the present disclosure.

It is understood that the present disclosure is not limited to any underlying implementing technology. The present disclosure may be implemented utilizing any combination of software and hardware technology. The present disclosure may be implemented using a variety of technologies without departing from the scope and spirit of the disclosure or without sacrificing all of its material advantages.

It is understood that the specific order or hierarchy of steps in the processes disclosed is an example of exemplary approaches. Based upon design preferences, it is understood that the specific order or hierarchy of steps in the processes may be rearranged while remaining within the scope of the present disclosure. The accompanying method claims present elements of the various steps in a sample order, and are not meant to be limited to the specific order or hierarchy presented.

It is believed that the present disclosure and many of its attendant advantages will be understood by the foregoing description, and it will be apparent that various changes may be made in the form, construction, and arrangement of the components thereof without departing from the scope and spirit of the disclosure or without sacrificing all of its material advantages. The form herein before described being merely an explanatory embodiment thereof, it is the intention of the following claims to encompass and include such changes.

What is claimed is:

1. An antenna system, comprising:

a circuit board, the circuit board defining a first surface and a second surface opposite to the first surface; and a plurality of integrated antenna elements individually packaged and separately positioned above the first surface of the circuit board, each integrated antenna element of the plurality of integrated antenna elements including an antenna element, a printed circuit board and a radio frequency integrated circuit chip, the printed circuit board positioned between the antenna element and the radio frequency integrated circuit chip, the radio frequency chip positioned between the printed circuit board and the first surface of the circuit board, wherein the antenna element, the printed circuit board and the radio frequency integrated circuit chip are positioned above the first surface of the circuit board, each integrated antenna element of the plurality of integrated antenna elements being packaged as a three-dimensional stack package, and the antenna element, the printed circuit board and the radio frequency integrated circuit chip of each integrated antenna element being separated from antenna elements, printed circuit boards and radio frequency integrated circuit chips of other integrated antenna elements.

2. The antenna system of claim 1, wherein the antenna element is connected to the radio frequency integrated circuit chip through the printed circuit board utilizing at least one via.

3. The antenna system of claim 1, wherein the plurality of integrated antenna elements form an electronically scanned array.

4. The antenna system of claim 1, wherein the antenna element is laminated to the printed circuit board, the radio frequency integrated circuit chip is encapsulated within a flat no-leads package, and the antenna element is connected to the radio frequency integrated circuit chip through the printed circuit board utilizing at least one via.

5. The antenna system of claim 1, further comprising:

additional integrated circuits positioned on the second surface of the circuit board.

6. The antenna system of claim 5, wherein the additional integrated circuits include at least one of: a frontend integrated circuit, a digital control integrated circuit, and an analog control integrated circuit.

7. The antenna system of claim 1, further comprising:

additional integrated circuits positioned on the first surface of the circuit board, wherein the plurality of integrated antenna elements are stacked on top of the additional integrated circuits.

8. An antenna system, comprising:

a circuit board, the circuit board defining a first surface and a second surface opposite to the first surface;

a plurality of integrated antenna elements, each integrated antenna element of the plurality of integrated antenna elements including an antenna element, a printed circuit board and a radio frequency integrated circuit chip, the printed circuit board positioned between the antenna element and the radio frequency integrated circuit chip, the radio frequency chip positioned between the printed circuit board and the first surface of the circuit board, wherein the antenna element, the printed circuit board and the radio frequency integrated circuit chip are positioned above the first surface of the circuit board, each integrated antenna element of the plurality of integrated antenna elements being packaged as a three-dimensional stack package, and the antenna element, the printed circuit board and the radio frequency integrated circuit chip of each integrated antenna element being separated from antenna elements, printed circuit boards and radio frequency integrated circuit chips of other integrated antenna elements; and a plurality of digital control integrated circuits, each particular digital control integrated circuit of the plurality of digital control integrated circuits corresponding to a particular integrated antenna element of the plurality of integrated antenna elements;

wherein each particular digital control integrated circuit is positioned above the first surface of the circuit board, each integrated antenna element of the plurality of integrated antenna elements is individually packaged, and the particular integrated antenna element corresponding to the particular digital control integrated circuit is stacked on top of the particular digital control integrated circuit.

9. The antenna system of claim 8, wherein the antenna element is connected to the radio frequency integrated circuit chip through the printed circuit board utilizing at least one via.

10. The antenna system of claim 8, wherein the plurality of integrated antenna elements form an electronically scanned array.

11. The antenna system of claim 8, wherein the antenna element is laminated to the printed circuit board, the radio frequency integrated circuit chip is encapsulated within a flat no-leads package, and the antenna element is connected to the radio frequency integrated circuit chip through the printed circuit board utilizing at least one via.

12. The antenna system of claim 8, further comprising:

additional integrated circuits positioned on the second surface of the circuit board.

13. The antenna system of claim 12, wherein the additional integrated circuits include at least one of: a frontend integrated circuit and an analog control integrated circuit.

14. A method for producing a package with integrated antenna elements, the method comprising:

forming a plurality of integrated antenna elements, each integrated antenna element of the plurality of integrated antenna elements including an antenna element, a printed circuit board and a radio frequency integrated circuit chip, each integrated antenna element of the plurality of integrated antenna elements being individually packaged as a three-dimensional stack package, and the antenna element, the printed circuit board and the radio frequency integrated circuit chip of each integrated antenna element being separated from antenna elements, printed circuit boards and radio frequency integrated circuit chips of other integrated antenna elements; and placing the plurality of integrated antenna elements above a surface of a circuit board, wherein the plurality of integrated antenna elements jointly form an antenna array, wherein the printed circuit board is positioned between the antenna element and the radio frequency integrated circuit chip, wherein the radio frequency chip is positioned between the printed circuit board and the first surface of the circuit board, wherein the antenna element, the printed circuit board and the radio frequency integrated circuit chip are positioned above the first surface of the circuit board.

15. The method of claim 14, wherein the antenna element is connected to the radio frequency integrated circuit chip through the printed circuit board utilizing at least one via.

16. The method of claim 14, wherein the plurality of integrated antenna elements form an electronically scanned array.

17. The method of claim 14, wherein the antenna element is laminated to the printed circuit board, the radio frequency integrated circuit chip is encapsulated within a flat no-leads package, and the antenna element is connected to the radio frequency integrated circuit chip through the printed circuit board utilizing at least one via.

18. The method of claim 14, further comprising:

placing additional integrated circuits on the second surface of the circuit board.

19. The method of claim 18, wherein the additional integrated circuits include at least one of: a frontend integrated circuit, a digital control integrated circuit, and an analog control integrated circuit.

20. The method of claim 14, further comprising:

placing additional integrated circuits on the first surface of the circuit board, wherein the plurality of integrated antenna elements are stacked on top of the additional integrated circuits.

* * * * *